US006021532A

United States Patent [19]

Ricke

[11] Patent Number: 6,021,532

[45] Date of Patent: Feb. 8, 2000

[54] SINK MOUNTING LOCK

[76] Inventor: James Ricke, 770 Hawthorne La., West Chicago, Ill. 60185

[21] Appl. No.: 09/303,927

[22] Filed: May 3, 1999

[51] Int. Cl.[7] ..... E03C 1/33

[52] U.S. Cl. ..... 4/633; 411/332; 411/535

[58] Field of Search ..... 4/631–636, 252.1, 4/619; 411/84, 161, 332, 535, 536, 546

[56] References Cited

U.S. PATENT DOCUMENTS 4,842,463 6/1989 Landt ..... 411/332

4,916,836 4/1990 Baggio et al. ..... 411/535

*Primary Examiner*—Steven O. Douglas
*Assistant Examiner*—Tuan Nguyen

[57] ABSTRACT

A device for securing a sink bowl in a counter top wherein a base unit has an annular inclined planar upper surface with a central stud extending therefrom. The stud engages a channel fixed to the underside of the sink flange such that when the base unit is rotated the inclined surface increasingly bears against the underside of the counter top drawing the sink flange into positive engagement with the upper surface of the counter top.

6 Claims, 1 Drawing Sheet

SINK MOUNTING LOCK

BACKGROUND OF THE INVENTION

1. Field of the Invention

The present invention relates generally to the field of fastening devices and more particularly to an improved clamping device for securing a sink bowl to a counter top.

2. Description of the Prior Art

Prior to the present invention, a sink clamping device ofthe type described in U.S. Pat. No. 4,613,995, which issued to the applicant herein on Sep. 30, 1986, was most representative of the prior art. Since that time, the applicant implemented certain design changes which represented improvements in the patented clamp and which will be described in more detail herein with reference to FIG. 1 of the drawings.

The prior art clamps exhibit several shortcomings in actual use. First, the clamp is formed of two components, one of a metallic spring material and the other a reverse threaded element having a head portion adapted to engage and be retained by a channel bracket affixed to the lower side of the sink flange. Aside from the assembly requirement, the components are expensive to manufacture. A further shortcoming is that the use of a screwdriver is necessary to tighten the prior art clamp in place. Particularly when installing a sink in an existing, in-place counter top, tightening the prior art clamp is an awkward operation.

OBJECTIVES AND SUMMARY OF THE INVENTION

From the preceding discussion, it will be understood that among the various objectives of the present invention are included the following:

- the provision of a new and improved clamping device for securing a sink to a counter top;
- the provision of a device of the above-described character formed as a single unit requiring no assembly operation; and
- the provision of a device of the above-described character adapted for installation without tools.

These, as well as other objectives of the present invention, are efficiently achieved by providing a generally cylindrical base unit, the upper surface of which is an annular inclined plane. The inclined surface may, but need not necessarily, be provided with steps or ridges. Extending upwardly of the base unit is a stud having a shoulder at its upper end for engaging the mounting channel affixed to the underside of a sink flange. The lower surface of the base unit may be provided with a downwardly extending flange, such that it may be gripped and turned by hand without the use of tools. In use, the mounting stud is inserted into the sink channel and then rotated, such that the inclined surface of the base unit is brought into engagement with the lower surface of the counter top in which the sink is to be mounted. Continued rotation causes the inclined surface to bear increasingly against the counter top thus drawing down the mounting stud and bringing the sink flange into positive engagement with the top surface of the counter top.

The foregoing as well as other objects, features and advantages of the present invention will become more apparent from the following detailed description taken in conjunction with the various views of the appended drawings.

DESCRIPTION OF PREFERRED EMBODIMENT

Figure 1:
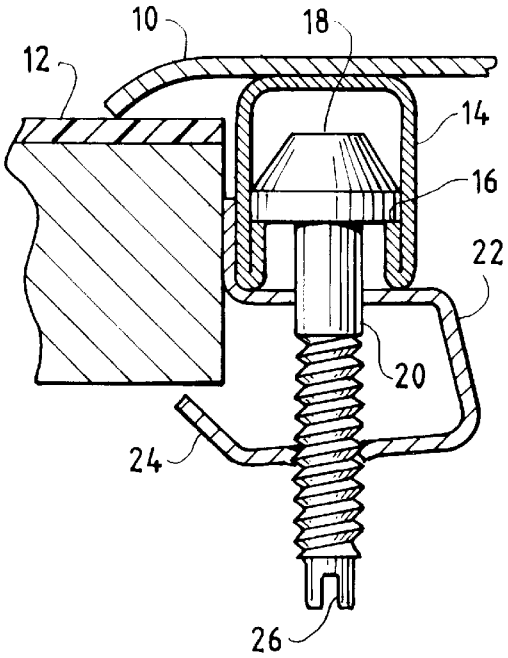
FIG. 1 PRIOR ART
FIG. 1 is a cross-section view of a sink mounting clamp most representative of the prior art.

With reference now to FIG. 1, there is illustrated in cross-section a prior art sink clamping device, which itself represents an improvement over the device disclosed in U.S. Pat. No. 4,613,995 and is in common use in the industry. This prior art device is used in combination with a sink flange 10, which is to be secured to a counter top 12. The sink flange 10 is provided at its lower surface with a generally u-shaped peripheral channel 14 having a linear internal shoulder 16. The enlarged head-end 18 of a threaded stud 20 inserted in the channel 14 and engages the internal shoulder 16. A spring clip 22, through which the stud 20 is threaded, seats against the lower edges of the channel 14 and has a lower arm 24 extending beneath the counter top 12. In practice, the stud 20 is reverse threaded such that when turned clockwise using a screwdriver inserted in slot 26, the head end 18 of stud 20 is drawn downwardly against the internal shoulder 16 of channel 14 and the lower arm 24 of spring clip 22 is pulled upwardly into engagement with the lower surface of counter top 12. The spring action of the clip 22 exerts a constant biasing action to retain the sink flange 10 in position with respect to the counter top 12.

Figure 4:
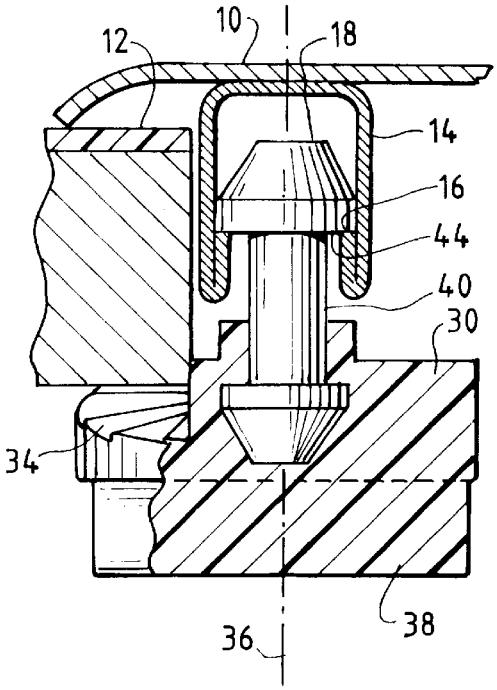
FIG. 4 is a cross-section view of the device of FIG. 2 as installed.
Figure 2:
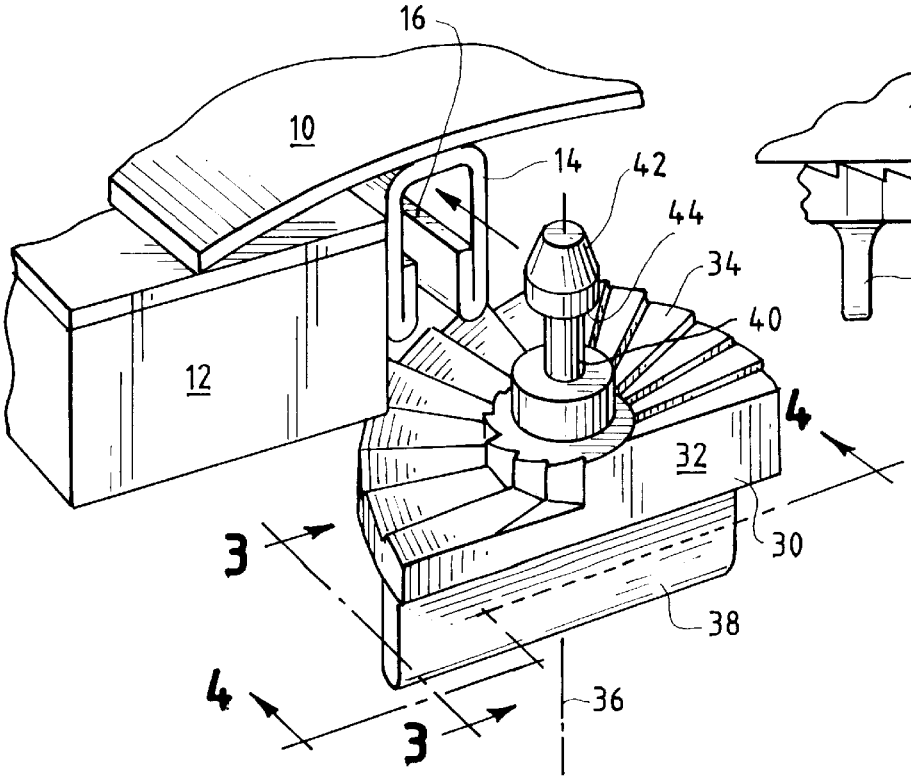
FIG. 2 is an elevation view of the clamping device of the present invention.

FIGS. 2 and 4 illustrates in elevation the clamping device of the present invention. As in FIG. 1, the sink flange 10 is provided with a unshaped channel 14 having a linear internal shoulder 16 proximate the internal edge of an opening in counter top 12 in which the sink is to be mounted. The present invention is intended to replace the spring clip/threaded stud assembly of FIG. 1.

The clamping device comprises a generally upright cylindrical base portion 30 having a vertical section removed to provide a flat vertical face 32. The upper surface of the base unit forms an annular inclined plane 34 about the centerline 36 of the cylinder. A downwardly extending grip flange 38 extends across the lower surface of the base unit 30 substantially through the cylindrical centerline 36.

Extending upwardly from the substantial center of the base unit 30 is a stud 40 having an enlarged head-end 42 to provide a shoulder 44 having a width approximating the internal width of the channel 14 attached to the sink flange 10. Thus when the stud 40 is inserted into the channel 14, the shoulder 44 of stud 40 engages the internal shoulder 16 of channel 14.

In use, the flat face 32 of the base unit 30 is aligned with the edge of the opening in counter top 12 and the enlarged end 42 of stud 40 is inserted in the channel 14 of the sink flange 10. Turning the device in the clockwise direction, the increasing thickness of the annular inclined plane 34 engages the underside of the counter top 12 and causes the base unit 30 to pull downwardly on the stud 40. The shoulder 44 of the stud 40 thus is pulled downwardly against the internal shoulder 16 of the channel 14 and secures the sink flange 10 to the counter top 12.

The base unit 30, stud 40 and grip flange 38 may easily and economically be formed by molding of a suitable thermoplastic material or by casting of a metal. Alternatively, the base unit could be molded around a metallic stud, as shown in the cross-section illustration of FIG. 4, wherein like elements are identified by like reference characters.

Figure 3:
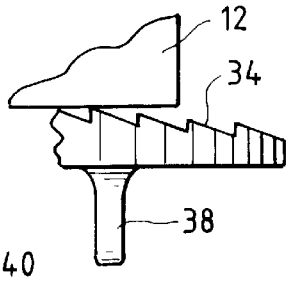
FIG. 3 is a cross-section view of the inclined surface detail of the device of FIG. 2.

FIG. 3 is a more detailed partial cross-section view of a portion of the annular inclined surface of the base unit 30 shown in FIGS. 2 and 4. In the illustrated embodiment, the annular upper surface 34 is inclined in steps such that when the grip flange 38 is rotated clockwise the steps tend to grip the underside of counter top 12 and thereby tend to prevent counterclockwise rotation and loosening of the clamp through vibration and the like. Alternatively, the annular surface could be provided with radial ridges for the same purpose.

From the foregoing, it will be understood that the applicant has provided a new and improved clamping device which is simple and economical of manufacture, requires no assembly and may be easily installed without requiring the use of any tools. Thus, the objectives set forth herein above are efficiently achieved. Since certain changes in the above-described construction will occur to those skilled in the art without departure from the scope ofthe invention, it is intended that all matter set forth in the above description or shown in the appended drawings shall be interpreted as illustrative and not in a limiting sense.

Having described what is new and novel and desired to secure by Letters Patent, what is claimed is:

1. A clamping device for securing a sink bowl to a counter top, said sink bowl being of the type including a perimeter flange overlying the counter top adjacent the perimeter ofthe opening in which the sink is to be mounted and said perimeter flange is provided on its lower surface with a downwardly open u-shaped peripheral channel having an internal shoulder, wherein said clamping device comprises:

a generally upright cylindrical base portion with a vertical section removed to provide a flat vertical face and having an upper surface forming an annular inclined plane about the centerline of the cylinder;

a stud extending upwardly from the center of said base portion and having an enlarged head end of a dimension approximating the width of said u-shaped peripheral channel of said sink flange and adapted to engage the internal shoulder thereof; and means for rotating said base portion about its centerline such that said annular inclined plane bears increasingly against the lower surface of said counter top drawing said stud downwardly against the internal shoulder of said channel and securing the said sink flange in positive contact with the upper surface of said counter top.

2. A clamping device of the character set forth in claim 1 wherein:

said means for rotating said base portion comprises a grip flange disposed across the lower surface of said base unit opposite said stud.

3. A clamping device of the character set forth in claim 2 wherein:

said base portion, said stud and said grip flange are molded as a unitary structure of a thermoplastic material.

4. A clamping device of the character set forth in claim 2 wherein:

said base portion, said stud and said grip flange are cast as a unitary structure of a metal material.

5. A clamping device of the character set forth in claim 1 wherein:

said annular inclined plane includes a plurality of steps formed therein for gripping the lower surface of said counter top whereby counterrotation of said base portion with respect to said counter top is impeded.

6. A clamping device of the character set forth in claim 1 wherein:

said base portion is molded of a thermoplastic material about said stud such as to be longitudinally and rotationally fixed with respect thereto.

* * * * *